United States Patent [19]

Miller

[11] 4,188,860

[45] Feb. 19, 1980

[54] LOCKING MECHANISM

[75] Inventor: Ivan O. Miller, Fullerton, Calif.

[73] Assignee: Shafco Industries, Inc., Buena Park, Calif.

[21] Appl. No.: 866,295

[22] Filed: Jan. 3, 1978

[51] Int. Cl.[2] ..... F15B 15/26

[52] U.S. Cl. ..... 92/15; 92/20; 92/23; 92/29

[58] Field of Search ..... 92/14, 23, 24, 26, 27, 92/28, 30, 113, 114; 188/67, 300; 92/15, 20, 29

[56] References Cited

U.S. PATENT DOCUMENTS

| | | | |
|---|---|---|---|
| 3,182,565 | 5/1965 | Millard | 188/300 |
| 3,228,307 | 1/1966 | Dillard | 92/26 |

FOREIGN PATENT DOCUMENTS

| | | | |
|---|---|---|---|
| 2034634 | 1/1972 | Fed. Rep. of Germany | 92/24 |
| 2164578 | 7/1973 | Fed. Rep. of Germany | 92/26 |

*Primary Examiner*—Abraham Hershkovitz
*Attorney, Agent, or Firm*—Lyon & Lyon

[57] ABSTRACT

A locking mechanism for hydraulically actuated devices is disclosed herein. The mechanism includes a slotted lock shaft coaxially mounted with respect to a piston assembly, the piston assembly being disposed in a hydraulic cylinder. The lock shaft has end faces or shoulders which engage a portion of a shaft associated with the piston assembly to lock the piston assembly and the ram shaft in a predetermined position. The lock shaft has a configured surface which cooperates with a configured surface of the piston assembly for unlocking the mechanism. The locking mechanism is described for use with a ram type blowout preventer but can be used with various types of hydraulically actuated devices.

11 Claims, 3 Drawing Figures

LOCKING MECHANISM

BACKGROUND OF THE INVENTION

The present invention relates to hydraulically actuated devices, and more particularly to a locking mechanism therefor.

While not intending to be limited thereby, the present locking mechanism will be described in connection with a ram type blowout preventer inasmuch as the locking mechanism is particularly useful therewith, but the present mechanism is useful with various types of hydraulically actuated devices.

Ram type blowout preventers include a pair of rams which are actuated to provide reliable sealing around drill pipe, across an open hole and for shearing drill pipe in various drilling situations. The rams usually are hydraulically actuated, and a number of these devices are provided with a mechanical assembly to lock the rams in the closed position once the rams have been actuated to the closed position. Usually no additional hydraulic force is required to maintain the rams in the locked position, and they generally can be opened only by the application of an opening hydraulic pressure.

Various types of mechanical locking devices have been provided. U.S. Pat. No. 3,242,826 to Smith illustrates a mechanical locking device for a ram type blowout preventer. The locking device uses a plurality of locking segments associated with the piston of the hydraulic assembly. A locking cone moves the locking segments outwardly, and the segments expand into a locking shoulder in the cylinder wall of the hydraulic cylinder/piston assembly. Locking devices of this nature have several drawbacks, among them being the fact that the locking segments score the cylinder wall, the segments cause increased friction, and the diameter of the ram actuator piston must be increased to provide sufficient force to move the locking cone and release the locking segments.

Other patents disclose various types of locking devices for ram shafts, but such devices are relatively complex and have various disadvantages. Among these is the device shown in U.S. Pat. No. 4,024,800 which uses a resilient catch member to lock a piston when the tubular locking cap is in a locking position. U.S. Pat. No. 3,186,163 illustrates a barrel detent in which a resilient element is compressed and a cam sleeve moves in a manner to move fingers out of engagement with a collar. U.S. Pat. No. 3,451,313 illustrates a locking actuator device having fixed fingers extending in a manner to engage a piston, and the piston includes a resiliently mounted locking plate which prevents the piston and the fingers from becoming disengaged until appropriate pressure releases the locking plate. U.S. Pat. No. 3,003,471 discloses a stroke and locking device using an auxiliary reciprocal sleeve piston which maintains fingers in locking engagement. Other patents of general interest include Allen U.S. Pat. No. 3,208,357, King No. 3,386,338, Fredd No. 3,395,618, and Walker No. 3,580,140.

While the prior art discloses various approaches to the problem of locking a hydraulic ram shaft, none appears to provide a positive lock by using positive locking surfaces as does the present invention, and generally the prior art devices involve complex assemblies which include devices or surfaces which tend to score the cylinder wall or piston surface or involve significant additional friction in operation.

SUMMARY OF THE INVENTION

The present locking mechanism is an improvement over prior locking devices because of its relatively simple construction and because of the fact that it causes no wear on the cylinder wall nor piston surfaces, and causes only minimal friction. The mechanism is used with a hydraulic mechanism comprising a cylinder, cylinder cover, piston assembly and ram shaft. The locking mechanism comprises a modified piston assembly and a lock shaft disposed in the cylinder and having a portion or area which cooperates with a locking surface of the ram shaft. With this construction, there is only minimal friction between the relatively small diameter lock shaft, ram shaft and piston assembly, and the locking mechanism causes no wear on the cylinder or outer surface of the piston. The lock shaft of the present mechanism is fixed and does not move with the piston. This arrangement involves less wear, complication and requires less space. The fingers of the lock shaft ride on the inside of the ram shaft and thereby avoid wear on the cylinder wall and piston surface. The lock shaft does not require special tooling, and the present locking mechanism provides a relatively simple, but yet positive, locking device.

Accordingly, it is a principal object of the present invention to provide an improved locking mechanism.

Another object of this invention is to provide an improved locking mechanism for hydraulically actuated devices, such as valves, comprising a locking shaft cooperating with a locking surface of a piston assembly.

Another object of the present invention is to provide a new form of locking mechanism for ram-type hydraulic devices.

THE DRAWINGS

These and other objects and features of the present invention will become better understood through consideration of the following description taken in conjunction with the drawings in which.

DETAILED DESCRIPTION

Figures 1, 2:
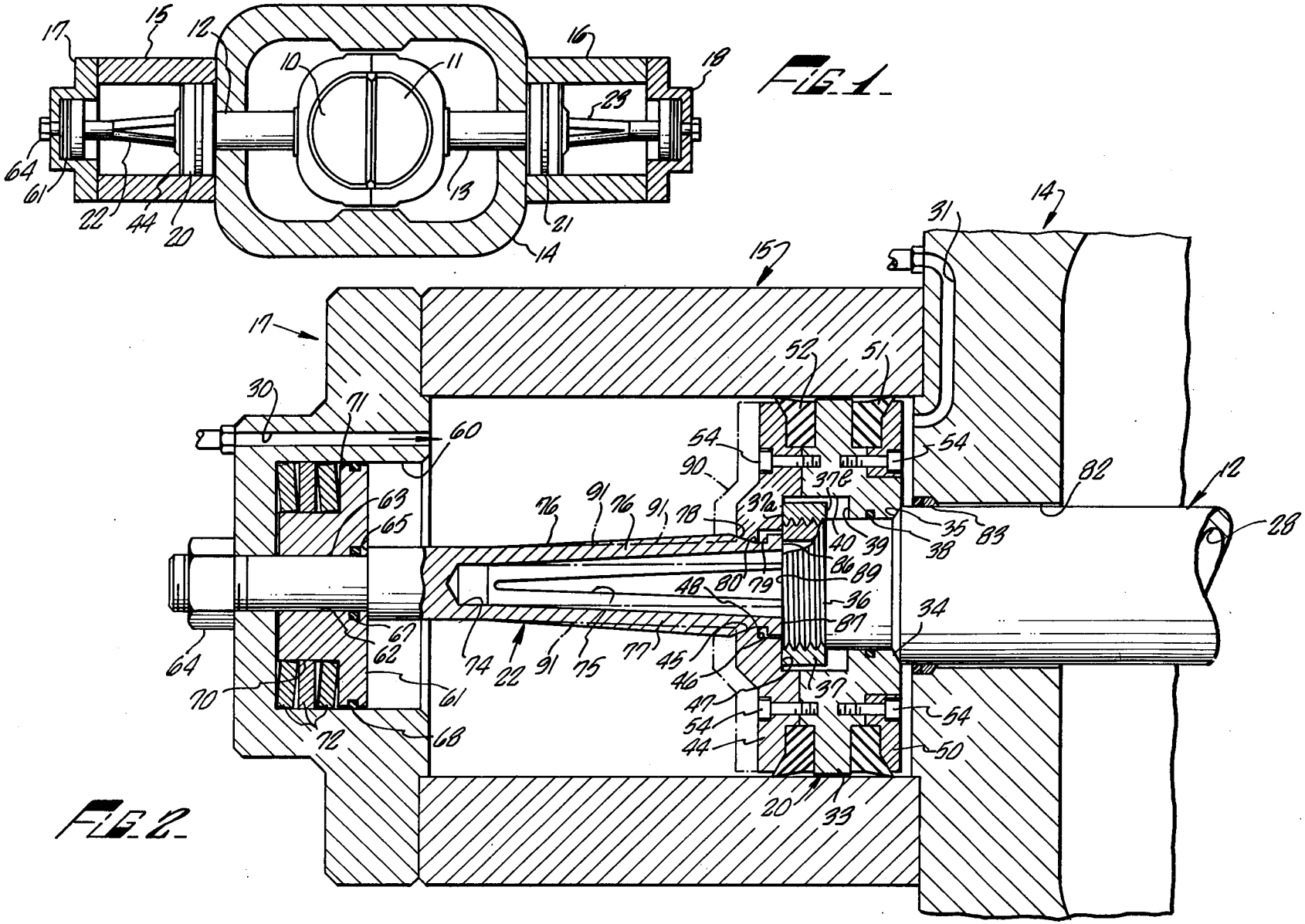
FIG. 1 is a diagrammatic cross-sectional view of a ram-type blowout preventer which has been modified to incorporate the concepts of the present invention.
FIG. 2 is a detailed cross sectional view of the locking mechanism of the present invention incorporated into the hydraulic actuator of a ram-type blowout preventer, and illustrates a piston assembly and ram shaft in a locked position.

Turning first to FIG. 1, a ram-type blowout preventer is diagrammatically illustrated comprising a pair of rams 10 and 11, affixed to respective ram shafts 12 and 13, all contained within a body or housing 14 of the blowout preventer. Hydraulic cylinders 15 and 16 are affixed to the sides of the housing 14 in a conventional manner, and have respective cylinder covers 17 and 18. A piston assembly 20 is disposed within the cylinder 15, and a piston assembly 21 is disposed within the cylinder 16.

As is well known to those skilled in the art, the rams 10 and 11 are adapted to close off a bore hole when the respective ram shafts 12 and 13 are moved inwardly in any suitable manner. The typical ram-type blowout preventer uses the cylinders 15 and 16 and piston assemblies 20 and 21 similar to the arrangement shown in FIG. 1, with the pistons being hydraulically actuated to operate the ram shafts 12 and 13 and rams 10 and 11 to the position illustrated in FIG. 1 to close off the bore hole. Similarly, the rams 10 and 11 can be retracted by the appropriate application of hydraulic pressure (to the right side of piston assembly 20 and to the left side of piston assembly 21) to retract the rams to an open position.

Figure 3:
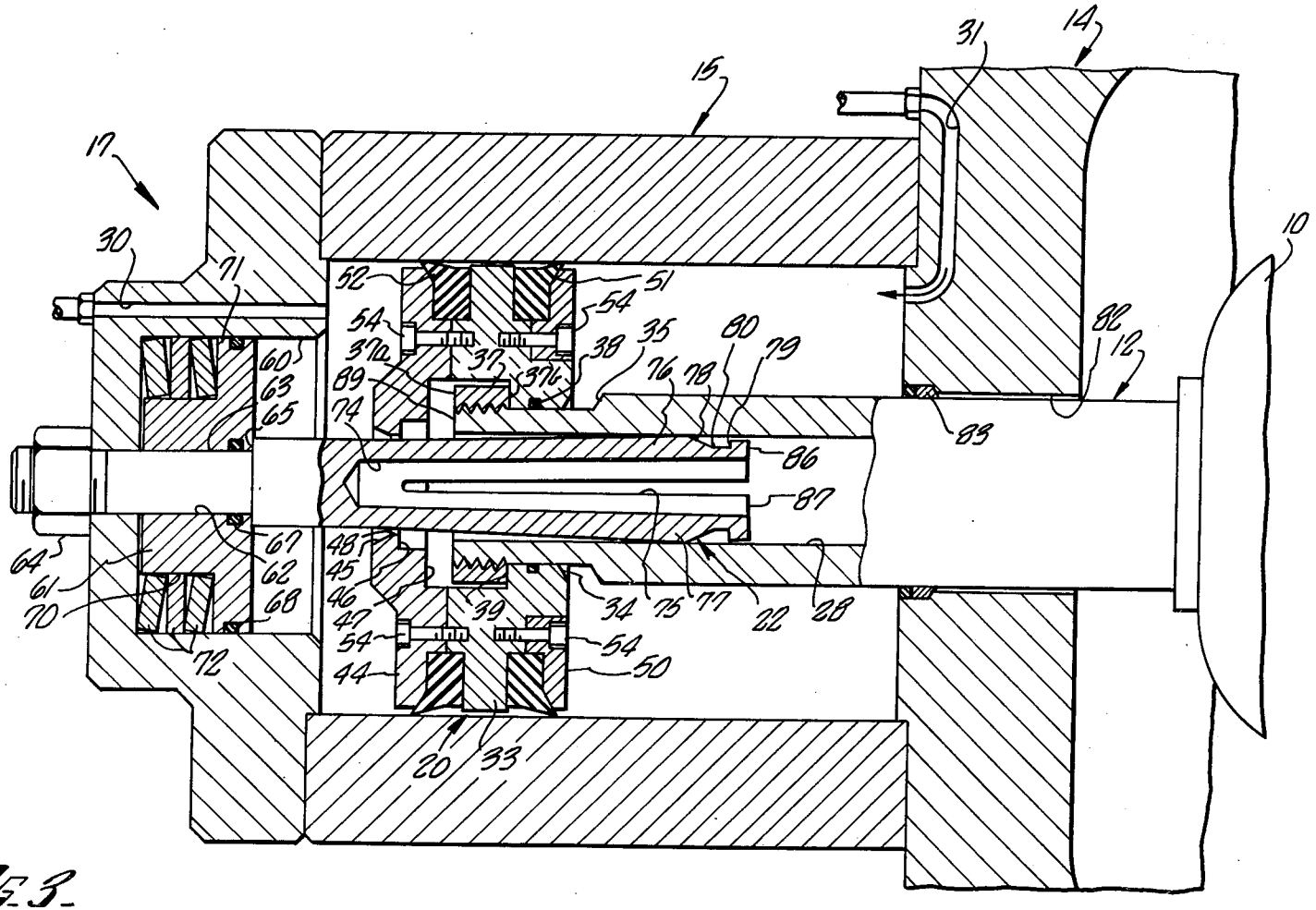
FIG. 3 is a cross sectional view similar to that of FIG. 2, but with the piston assembly and ram shaft in an unlocked position.

The apparatus illustrated in FIG. 1 is modified in accordance with the present invention by the addition of slotted locking shafts 22 and 23 which cooperate with locking surfaces of the ram shafts 12 and 13 and with end caps of the piston assemblies 20 and 21, and these shafts and other modifications will be described in more detail in conjunction with a discussion of FIGS. 2 and 3.

Turning now to FIG. 2, the cylinder 15 and piston assembly 20 at the lefthand side of the apparatus shown in FIG. 1 illustrated in greater detail, it being understood that the cylinder 16 and piston assembly 21 shown at the right hand side of the apparatus of FIG. 1 is the same. A hydraulic fluid port 30 is provided in the cylinder cover 17, and a similar port 31 is provided in the housing 14 for applying hydraulic fluid pressure to respective sides of the piston assembly 20 within the cylinder 15. The piston assembly 20 includes a slidable end plate 33 having a tapered end 34 which mates with a tapered shoulder 35 of the ram shaft 12 when the piston assembly moves to the right as seen in FIGS. 2–3. The left end of the ram shaft 12 is threaded at 36 and has a lock nut 37 with square faces **37*a*–37*b* secured thereon. The ram shaft 12 has a bore 28 therein to receive the lock shaft 22 as will be described more fully later. The slidable plate 33 has an O-ring seal 38, and has a shoulder 39 and an enlarged area at 40** for purposes which will be described subsequently.

The piston assembly 20 also includes a piston end cap 44 which has a tapered end 45, square inner shoulder 46, and a square inner shoulder 47 (similar to shoulder 39 of slidable plate 33) which will be described in greater detail subsequently. A ring area 48 is defined between the taper 45 and shoulder 46. The piston assembly further includes a retainer 50, and lip type resilient sealing rings 51 and 52. The piston assembly 20 is held together by cap screws 54.

The cylinder cover 17 includes a cylindrical recess 60 within which is mounted a lockshaft retainer 61. The retainer 61 includes a bore 62 for receiving an end 63 of the slotted lock shaft 22, this end 63 extending through the cylinder cover 17 and being secured by a nut 64. The lock shaft 22 has a shoulder 65 which bears on the right hand surface of the lock shaft retainer 61. An O-ring seal 67 is provided in a slot in the retainer 61 around the end 63 of the lock shaft 22. Similarly, an O-ring seal 68 seals the outer periphery of the lock shaft retainer 61 with the bore 60 in the cylinder cover 17. The diameter of the retainer 61 is reduced at 70 forming a flange 71, and Belleville disc springs 72 (or molded synthetic rubber rings of suitable shore hardness) are provided in the annular space defined between 70 and bore 60 for purposes to be described subsequently.

The lock shaft 22 comprises a rod which has a drilled out portion indicated at 74, and is slotted at 75 to provide upper and lower resilient fingers 76 and 77. The outer periphery of the fingers 76 and 77 is circular, and a taper 78 and square shoulder 79 are provided to mate with the taper 45 and square shoulder 46 of the piston end cap 44. An annular groove 80 is defined in the fingers 76 and 77 between the taper 78 and shoulder 79.

FIG. 2 illustrates the assembly in a locked position with the ram shaft 12 in its fully extended position (fully to the right and in the position illustrated in FIG. 1). FIG. 3 illustrates the assembly with the ram shaft 12 and ram 10 moving toward the retracted position. Hydraulic fluid pressure applied to the interior of the cylinder 15 through the port 30 in the cylinder cover 17 causes the piston assembly 20 to move axially to the right toward a closing position by moving the ram shaft 12 through a bore 82 which is sealed at 83. The resilient fingers 76 and 77 of the slotted lock shaft 22 are compressed by the ring area 48 of the piston end cap 44 during movement of the piston assembly 20 (e.g., to the right as seen in FIG. 2) until the ram shaft 12 and piston assembly 20 are in a fully-closed position, that is, prior to the ring area 48 reaching the taper 78 of the fingers 76 and 77. When the fully-closed position is reached, the slotted lock shaft 22 is no longer under compression and expands to cause shoulders 86 and 87, which are defined by the extreme right end faces of the resilient fingers 76–77, of the lock shaft 22 to engage the extreme left-end surface 89 of the ram shaft 12 to thereby prevent longitudinal movement of the ram shaft 12 (note also FIG. 3). In this regard, it should be noted that as the piston assembly 20 moves to the fully-closed position (to the right as seen in FIG. 2), the tapered surface 45 on the piston end cap 44 rides down on the tapered surface 78 around the lock shaft 22 at the ends of the resilient fingers 76 and 77, and thereby allows these fingers 76 and 77 to expand outwardly which, in turn, causes the shoulders 86 and 87 to engage the end face 89 of the ram shaft 12. The lock shaft 22 is secured in a fixed position in the cylinder cover 17 by the nut 64 and bears against the lock shaft retainer 61 as described above. The seals 67 and 68 provide a seal against fluid pressure and make the retainer 61 act like a piston against the Belleville disc springs in order that these springs can maintain tension on the lock shaft 22 and compensate for wear or infraction in the length of the lock shaft 22.

The assembly will remain locked even if hydraulic pressure is removed from port 30. In order to release the locking device, hydraulic fluid is applied into the cylinder 15 through port 31, and as the pressure increases against the right hand side of the piston assembly 20, the piston assembly 20 moves axially along the left end of the ram shaft 12 because of the space 40 defined between the shoulder 39 of the end plate 33 and shoulder 47 of end cap 44 and and the shorter axial length of the lock nut 37 on the end of the ram shaft 12. That is, the piston assembly 20 can move a small amount relative to the end of the ram shaft 12. The provision of this "travel area" of sufficient length between the shoulder 39 of plate 33 and shoulder 47 of cap 44 thereby permits limited free travel of the piston assembly 20 with respect to the end of the ram shaft 12 to allow the fingers 76 and 77 to fully expand when the ram shaft moves to the closed position, while also allowing the ring area 48 of cap 44 to compress these fingers upon initial movement of the piston assembly 20 when pressure is applied to port 31. This action allows the tapered end 45 of the piston end cap 44 to engage with and slide along the tapered surface 78 of the lock shaft 22 when the piston assembly 20 moves to the left to thereby press together the fingers 76 and 77 of the lock shaft 22, so that the end of the shaft 22 will freely enter the bore 28 in the ram shaft 12. This action is shown by phantom lines 90 which represent leftward movement by the piston end cap 44 and phantom lines 91 which illustrate inward movement or compression of the fingers 76 and 77 of the lock shaft 22. The shoulder 39 of the slidable plate 33 of piston assembly does not engage the right end of the lock nut 37 until the fingers 76 and 77 of the lock shaft 22 have been sufficiently compressed to allow the end thereof to enter the bore 28 of the ram shaft 12. At this point, the piston assembly 20, via the shoulder 39 of plate 33, engages the right surface **37*b* of the lock nut 37 to cause the ram shaft 12 to move longitudinally to an open position (to the left as seen in FIG. 3). The O-ring seal 38 provides a seal with the end of the ram shaft 12**.

The bore 28 of the ram shaft 12 is of sufficient diameter to receive the lock shaft 22, and the wall thickness of the shaft 12 is sufficient to allow the end 89 thereof to engage the shoulders 86 and 87 of the lock shaft 22. The relative configurations and diameters of the ring area 48 of the cap 44 and groove 80 of the fingers 76 and 77 allow proper expansion of the fingers 76 and 77 so that the shoulders 86 and 87 can lock against end surface 89 of the ram shaft 12, and likewise the tapers 45 and 78 and the "travel area" 40 allow sufficient compression of the fingers to allow retraction of the piston assembly, ram shaft and ram. Upon closing the ram, hydraulic fluid pressure of, for example, fifteen hundred psi acts equally against the piston assembly 20 and the lock shaft retainer 61 when pressure is applied through the port 30 and thereby creates a piston-like effect on the retainer 61. This double action fluid pressure assures a fully-locked position of the ram shaft 12 by compensating for any variation in the length of the lock shaft 22 as a result of machining or wear. The lock shaft 22 is made from selected heat-treated alloy steel for both strength and resiliency. The lip-type seals 51 and 52 of the piston assembly 20 are made from oil and heat resistant long-wearing synthetic materials.

While an embodiment and application of this invention has been shown and described, it will be apparent to those skilled in the art that modifications are possible without departing from the inventive concepts herein described.

What is claimed is:

1. A locking mechanism for a piston and cylinder assembly for locking a ram shaft associated with the piston into a predetermined locked position, wherein the piston is moved with respect to the cylinder by the application of fluid pressure and the cylinder has an end cap, comprising lock shaft means substantially fixed with respect to the cylinder and the end cap of the cylinder, said lock shaft means including elongated resilient finger means having a predetermined configuration at the end thereof, the ram shaft having a bore therein for receiving said finger means of said lock shaft means, and said piston is movable axially with respect to the ram shaft, said piston including end cap means for compressing said finger means of said lock shaft means to allow said finger means to enter and ride within the bore of the ram shaft when the piston is in a first range of positions with respect to the cylinder, and to allow said finger means to expand and the end thereof to engage a locking surface of the ram shaft to lock said ram shaft in the locked position.

2. A locking mechanism as in claim 1 wherein said piston is disposed on an end of the ram shaft to allow limited travel of the piston axially with respect to the ram shaft, and said end cap means of said piston has a configured surface cooperating with a configured surface at the end of the finger means to allow said end cap means of said piston to move a predetermined amount with respect to said ram shaft and compress said finger means of said lock shaft means to thereby allow said finger means to enter the bore of the ram shaft.

3. A locking mechanism as in claim 1 wherein said finger means of said lock shaft means comprise a pair of resilient fingers wherein the ends of said fingers define said end surface of said finger means and thereby form a locking surface, and the locking surface of the ram shaft comprises an end of the ram shaft which directly abuts the end surface of said finger means when said ram shaft is in the locked position.

4. A locking mechanism as in claim 1 wherein said piston is mounted on an end of the ram shaft, and said piston has an internal recess defining a travel area with respect to a member disposed on the end of the ram shaft, the travel area allowing limited movement of the piston with respect to the end of the ram shaft to enable a surface of said end cap means to ride on a surface of the finger means having a predetermined configuration for compressing the finger means to allow the end of the finger means to enter the bore in the ram shaft for unlocking the ram shaft.

5. A locking mechanism as in claim 1 wherein retainer means is resiliently mounted in the end cap of the cylinder, and the lock shaft means abuts the retainer means, and restraint means affixed to said lock shaft abuts the end cap of the cylinder.

6. A locking mechanism as in claim 1 wherein said piston is disposed for limited movement on said ram shaft, and said finger means comprise a pair of resilient fingers and the end surface of the finger means comprises shoulders at the ends of said fingers, and said finger means has a configured groove near the end thereof for mating with a configured surface of the end cap means of said piston and causing said fingers to be compressed for entering the bore of the ram shaft when said piston is moved a predetermined amount with respect to the ram shaft.

7. A locking mechanism for a piston and cylinder assembly for locking a ram shaft associated with the piston into a predetermined locked position, wherein the piston is moved with respect to the cylinder by the application of fluid pressure and the cylinder has an end cap, comprising lock shaft means substantially fixed with respect to the cylinder and the end cap of the cylinder, said lock shaft means including elongated resilient finger means, the ram shaft having a bore therein for receiving said finger means of said lock shaft means, said piston is disposed on an end of the ram shaft to allow limited travel of the piston axially with respect to the ram shaft, said piston including end cap means, and said end cap means of said piston has a configured surface cooperating with a configured surface at the end of the finger means to allow said end cap means to move a predetermined amount with respect to said ram shaft and compress said finger means of said lock shaft means to thereby allow said finger means to enter the bore of the ram shaft, and to allow said finger means to expand and the end thereof to engage a locking surface of the ram shaft to lock said ram shaft in the locked position, said finger means of said lock shaft means comprise a pair of resilient fingers wherein the ends of said fingers form a locking surface, and the locking surface of the ram shaft comprises an end of the ram shaft which directly abuts the locking surface of said finger means when said ram shaft is in the locked position.

8. A locking mechanism as in claim 7 wherein said piston has an internal recess defining a limited travel area with respect to a member disposed on the end of the ram shaft, the travel area allowing limited movement of the piston with respect to the end of the ram shaft to enable the configured surface of said end cap means to ride on the configured surface of the finger means for compressing the finger means to allow the end of the finger means to enter the bore in the ram shaft for unlocking the ram shaft.

9. A locking mechanism as in claim 7 wherein retainer means is resiliently mounted in the end cap of the cylinder, and the lock shaft means abuts the retainer means to resiliently limit locking shaft movement in a first direction parallel to the axis of the locking shaft, and restraint means affixed to the lock shaft abuts the end cap of the cylinder for limiting locking shaft movement in a second direction parallel to the axis of the locking shaft.

10. A locking mechanism for a piston and cylinder assembly for locking a ram shaft associated with the piston into a predetermined locked position, wherein the piston is moved with respect to the cylinder by the application of fluid pressure and the cylinder has an end cap, comprising lock shaft means substantially fixed with respect to the cylinder and the end cap of the cylinder, said lock shaft means including elongated resilient finger means having a predetermined configuration at the end thereof and having an end surface, the ram shaft having a bore therein for receiving said fingers of said lock shaft means, said piston including end cap means for compressing said finger means of said lock shaft means, and said piston is disposed for limited movement on said ram shaft, said finger means comprise a pair of resilient fingers and the end surface of the finger means comprises shoulders at the ends of said fingers, said shoulders forming a locking surface, and said finger means has a configured groove near the end thereof for mating with a configured surface of the end cap means of said piston and causing said fingers to expand and the locking surface of said finger means to engage a ram shaft locking surface to lock said ram shaft in position when said piston is moved a first predetermined amount with respect to the ram shaft, and causing said fingers to be compressed for entering the bore of the ram shaft when said piston is moved a second predetermined amount with respect to the ram shaft, and said ram shaft locking surface comprises an end of the ram shaft which directly abuts the locking surface of said finger means.

11. A locking mechanism for a piston and cylinder assembly for locking a ram shaft associated with the piston into a predetermined locked position, wherein the piston is moved with respect to the cylinder by the application of fluid pressure and the cylinder has an end cap, comprising lock shaft means substantially fixed with respect to the cylinder and the end cap of the cylinder, said lock shaft means including a pair of elongated resilient fingers having a configured surface near the end thereof and the end defining an end surface, the ram shaft having a bore therein for receiving said fingers of said lock means, and said piston including end cap means for compressing said fingers of said lock shaft means, said piston being disposed on an end of the ram shaft to allow limited travel of the piston axially with respect to the ram shaft, and said end cap means of said piston having a configured surface cooperating with the configured surface at the end of the fingers to allow said end cap means of said piston to move a predetermined amount with respect to said ram shaft and compress said fingers of said lock shaft means when pressure is applied in one direction to the piston to thereby allow said fingers to enter the bore of the ram shaft, and to allow said fingers to expand and the end surface thereof to engage the end of the ram shaft to lock said ram shaft in the locked position when pressure is applied in a second direction to the piston.

* * * * *